United States Patent [19]

Kent et al.

[11] 3,950,638

[45] Apr. 13, 1976

[54] HIGH INTENSITY INDIRECT LIGHTING FIXTURE

[75] Inventors: S. Leonard Kent, Andover; Thomas M. Lemons; Robert B. MacLeod, Jr., both of Marblehead, all of Mass.

[73] Assignee: Lam Incorporated, Wakefield, Mass.

[22] Filed: Nov. 14, 1973

[21] Appl. No.: 415,836

[52] U.S. Cl. .... 240/41.1; 240/41.35 R; 240/73 LD; 240/78 LG; 240/103 R

[51] Int. Cl.[2] F21M 7/00; F21M 13/00; F21V 7/00; F21S 1/06

[58] Field of Search ..... 240/78 LG, 73 LD, 78 LD, 240/78 LH, 103 R, 41.1, 41.35

[56] References Cited

UNITED STATES PATENTS 2,151,309 3/1939 Ainsworth ..... 240/103 R X

*Primary Examiner*—Richard A. Wintercorn

[57] ABSTRACT

A luminaire for use with high intensity discharge lamps so that such lamps can be used in rooms of average height even as low as 8 or 9 feet. The luminaire includes a suspended bowl-shaped reflector that opens towards the ceiling and prevents glare and direct viewing of the light source.

9 Claims, 5 Drawing Figures

HIGH INTENSITY INDIRECT LIGHTING FIXTURE

BACKGROUND OF THE INVENTION

1. Field Of The Invention

The present invention relates to luminaires which are to be used with high intensity light sources beneath relatively low ceilings such as found in schools, offices and shops. Specifically this invention relates to luminaires that are to be used with high intensity discharge lamps to prevent introduction of significant glare.

2. Description Of The Prior Art

High intensity discharge lamps have been used to light rooms although they are more commonly applied to outdoor illumination. These lamps have a very high luminous efficiency, frequently in the order of 50 to 120 lumens per watt. In turn, they are quite bright, frequently producing 3,000 to 1,000,000 foot lamberts. Interior spaces have sufaces that vary from 10 to 100 foot lamberts at normal illumination levels and the introduction of illumination within such spaces should be accomplished with a system which does not produce significant glare. Glare is considered significant if luminance ratios between areas in the room exceed 10 to 1 which therefore limits normal interior brightness to a maximum of 100 to 1000 foot lamberts. Because of the brightness of the lamps, they should not be viewed directly nor should an image of the source be seen in reflectors or lenses that are associated with them.

Most interior illumination has been accomplished with the use of incandescent or fluorescent lamps. In general, fluorescent lamps are not so bright as to produce significant glare, but as with most light sources, they are shielded and controlled by lenses and diffusers to reduce and regulate luminance. Lighting fixtures are therefore normally designed so that high luminance is eliminated or seen at only certain viewing angles where glare is not considered detrimental.

One of the more conventional approaches to illumination with high intensity light sources has been to dispose the lamp axially in a bowl-shaped reflector which is mounted in or suspended from the ceiling with the mouth facing downwardly. The use of this fixture without further modification, however, is impractical even with relatively high ceilings. Placing a refractor or lens over the mouth of the fixture reduced the direct glare, somewhat, but this approach has produced other problems. High intensity discharge lamps radiate a substantial amount of heat, and entrapping the heat within the fixture can distort the emission color of the lamp and shorten its life. Dirt which collects on the refractor or lens must be kept to a minimum with periodic maintenance or else the glare control capabilities are lost.

Other methods of controlling glare from conventional systems include special reflector designs which by their shape or combination with prismatic refractors limit light in directions which are within the normal viewing range. The mouth of the luminaire often includes cones which are blackened or otherwise reduced in brightness to limit the ability to see high luminance elements. Louvers are also used over the mouth for this purpose. Each of these elements absorbs energy which decreases the efficiency of the system.

Any attempt to incorporate high intensity discharge lamps into an indirect luminaire with no consideration for optical control could result in a unit whose appearance is somewhat similar to that illustrated by this invention. The photometric performance of such a luminaire could be similar to that shown in FIG. 3. This illustrates that such a luminaire might substantially eliminate light from below the horizontal but most of the energy would be in the 90° zone above the luminaire (45° on each side of the vertical). This concentration of energy would be unacceptable for most installations, since the ceiling adjacent to the luminaire would receive most of the light. To achieve acceptable uniformity of illumination across the ceiling, an optical design such as that illustrated by this invention is required.

DESCRIPTION OF THE PREFERRED EMBODIMENTS

According to the present invention, the abilities of an indirect lighting system are combined with the advantages of high intensity discharge lamps. With an indirect system, the lamp and any lenses or reflectors are shielded from view behind a portion of the fixture. In that way, the glare of high intensity devices cannot be seen. But because of the extremely high luminous efficiency produce by high intensity discharge lamps, only one fixture need be used where many incandescent or fluorescent lamps were required formerly.

The lamp is vertically mounted, that is, the axis of the lamp is vertically disposed within a reflector that opens upwardly towards the ceiling from which it is suspended. In practice, the fixture can be disposed anywhere from 18 inches to several feet from the ceiling. Quite importantly, the usefulness of this invention is not impaired by the shape or angle of the ceiling and the fixture can be suspended equally well from flat, sloped or even irregularly shaped ceilings. The reflector is disposed around the lamp, and in this way the lamp is shielded from view at all points below the horizontal. Because of the design of the reflector, direct view of reflected images of the light source is also eliminated. Suspending the lamp and reflector can be accomplished with a single tubular conduit that is attached to the ceiling by a conventional fitting at one end and the fixture at the other. Preferably the conduit is attached to a socket in which the lamp is disposed and the reflector is suppoted by radial spokes extending from the socket, or socket holder.

Figure 5:
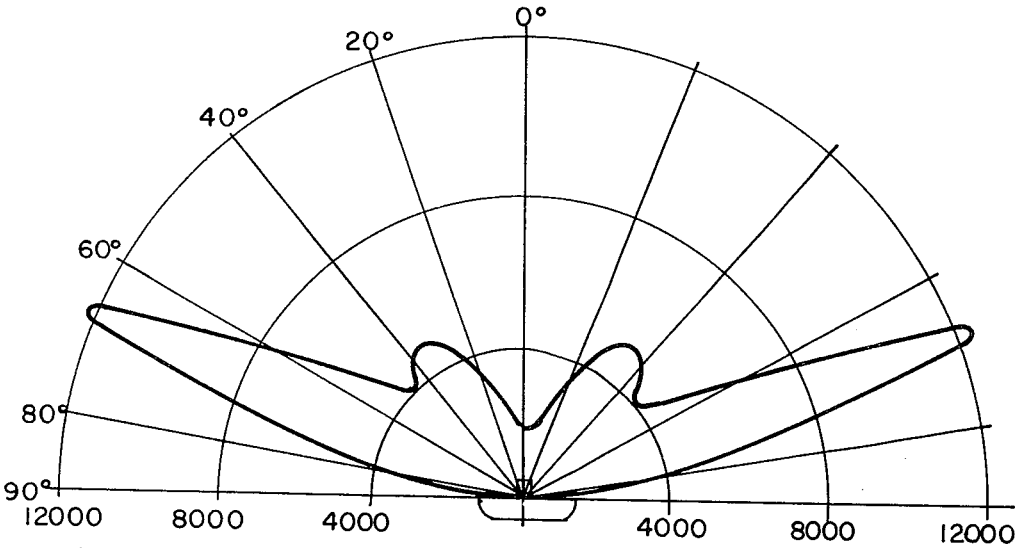
FIG. 5 is another candlepower distribution curve in which a clear 400 watt high intensity discharge lamp is disposed within the same fixture used in FIGURE 4.
Figure 4:
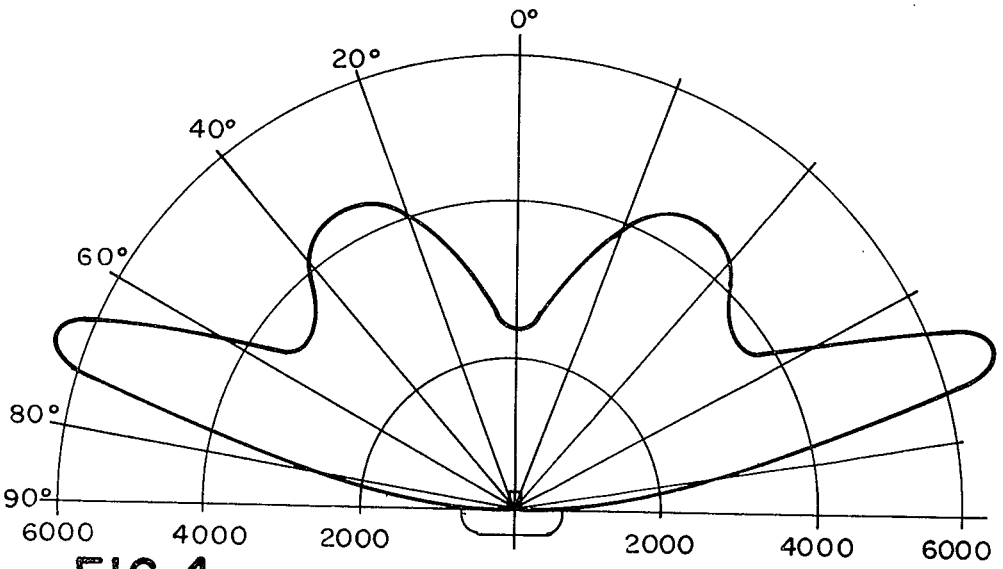
FIG. 4 is another candlepower distribution curve illustrating the distribution from a 400 watt high intensity phosphor coated discharge lamp which is disposed within the fixture of the present invention.

FIGS. 4 and 5 illustrated the use of different lamps in the fixture of the present invention. Measurements were made at various points around the lamp and the curve represents constant luminosity on the radius. As can be seen, substantially all of the light emitted from the source is emitted upwardly and the glare from the lamp cannot be seen from an angle greater than the horizontal.

Particularly with regard to FIGS. 4 and 5, the lamps can illuminate all corners of a room in which they are placed and reflect from these walls onto the surfaces therebeneath. With the rather well distributed light pattern of these lamps, significant glare is eliminated.

With the design of the reflector, the light emitted by the lamp is either directed or reflected upwardly. The shape of the reflector is such that the path of the reflected light is as close to the horizontal as possible.

The optical design that is used in the present system minimizes all direct light emission below horizontal and maximizes all direct light emission above the horizontal. Efficiency of the fixture is insured by directing substantially all light that emerges from the lamp out of the luminaire after no more than one reflection. Thus no substantial amount of light is trapped, refracted or re-reflected through the lamp, the socket cover or the supporting stem.

In the present invention, an ellipse is used as the optical shape. One focus of the ellipse is at the light source, along the arc tube of the lamp. The second focus is located over the outer rim of the reflector thereby making the side walls of the reflector an elliptical surface of revolution which is revolved around the vertical axis of the light source. The displacement of the focal point at the light source below the horizontal cut-off plane is substantially equal to the height above the lip of the second focal point to maximize the light produced just above the horizontal.

The sidewalls of the reflector are formed into fluted segments which are at a slight angle to the path of light from the source. This angle causes the light to be reflected past the socket cover, lamp and stem components to the second focal point which is located immediately above the lip of the reflector, as described previously. The addition of the fluted segments around the sidewalls of the reflector eliminates any detrimental absorption of energy by the above mentioned components.

Figure 1:
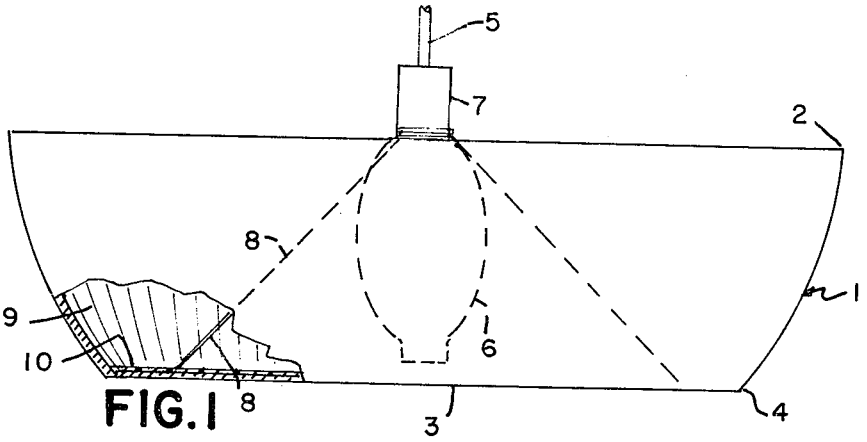
FIG. 1 is a side elevation, partly in cross section, of the luminaire of the present invention.

Referring now to the drawings in greater detail and particularly to FIG. 1, the fixture is shown to include an upwardly opening bowl 1 having a generally circular outer lip 2 and a base 3 integrally attached at the lower edge 4. The interior of the bowl 1 is provided with flutes for improved light distribution as will be described hereinafter.

Extending downwardly from a support stem 5 and disposed within the optical system is a generally vertically extending high intensity discharge device, commonly a mercury lamp, a high pressure sodium lamp or a metallic-halide lamp. As those in the art will appreciate, such lamps generally include an outer glass envelope which encloses elongated, hollow sealed arc tube having spaced apart electrodes disposed at both ends. The arc tube is supported within the envelope by a harness or frame that also constitutes a part of the electrical system. The other part of the electrical system includes a connection between the base cap and the arc tube.

When the lamp is operating, metallic ions disposed between the electrodes create a low resistance path so that an arc can form between the electrodes to provide an elongated light source. The light source is specifically located, relative to the bowl 1, the lip 2 and the base 3 so as to provide the newly discovered photometric distribution. This positioning is accomplished by fixing the socket cover 7 and radially extending, supporting spokes 8. Preferably, the spokes 8 extend from a convenient point on the socket cover 7 and are preferably attached to clips disposed upon the lower edge 4.

Figure 2:
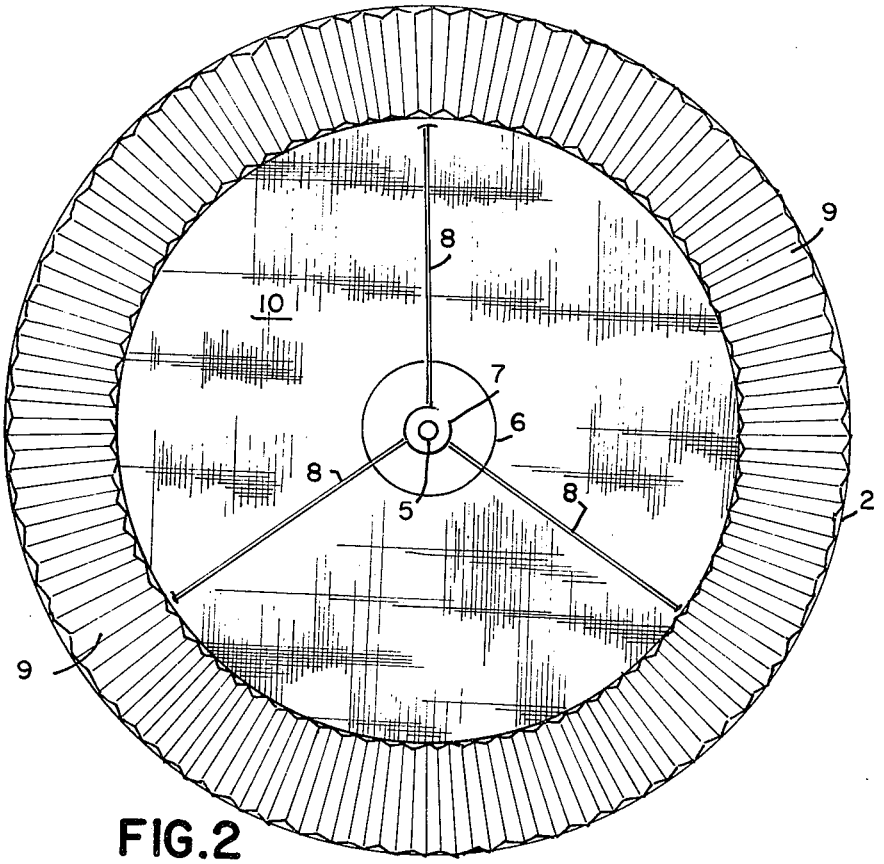
FIG. 2 is a top plan view of the luminaire shown in FIG. 1.

The bowl 1 is generally symmetrical about its vertical axis and is circular in any horizontal cross section, the diameter thereof decreasing from the lip 2 to the edge 4. As an alternative, the bowl 1 can be formed of a large number of flat segments, generally approximating a circle. A plurality of vertically disposed flutes (best shown in FIG. 2) are located within the bowl. These flutes 9 most advantageously begin at the edge 4 and extend upwardly to the lip 2. They may be formed integrally with the bowl 1, so as to actually form the sides thereof or they may be a stamped insert which can extend from the edge 4 to the lip 2 inside a bowl which forms an outer housing.

The flutes are arranged so that light which is emitted from the source on a generally horizontal plane will be reflected back by the source and out of the reflector immediately above the lip. As mentioned above, the flutes provide the directioning to redistribute the light without producing significant glare. The path of the reflected light can be such that it passes the lamp 6, socket cover 7 and stem 5 and continues out above the lip 2. The light then passes into the room for illumination. Of course any light which is emitted upwardly from the lamp will pass above the lip 2 and also pass into the room for illumination.

The base 3 is lined with a reflective or refractive surface that is disposed thereon to diffuse the light rays that are directed upon it. Many ways of forming the reflective surface can be utilized such as etching, peening or embossing. But the preferred approach involves a plastic or glass refractor sheet material 10 that is cut into a shape which will coincide with the lower edge 4.

With these elements in the lighting system, the distribution of energy from the light source is maximized just above the horizontal and then gradually reduced to a minimum directly over the light source. Such distribution achieves a desirable uniformity of illumination over the ceiling surface. The ceiling becomes the source of illumination for the remainder of the room and luminance ratios are thus held within 10 to 1. The high intensity discharge devices can thus be used indoors and meet quality requirements for such areas.

Figure 3:
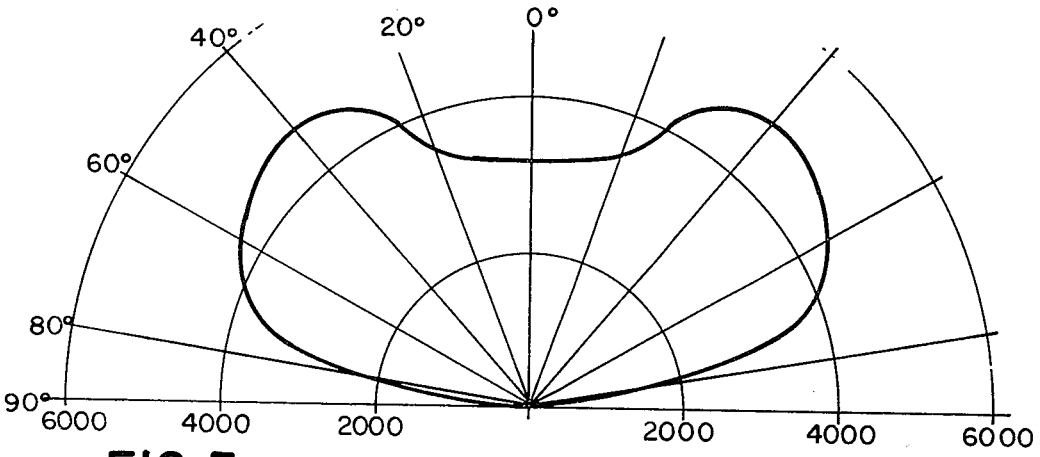
FIG. 3 is a candlepower distribution curve illustrating the distribution of light from a high intensity discharge lamp disposed within an indirect luminaire with no consideration for optical control.

Referring to FIGS. 3 to 5, the curves are prepared by measuring the luminous intensity on planes which pass through the lamp and stem axis. They are the average intensity in candela at various angles from the vertical which occur in any of these planes.

Particularly with regard to FIGS. 4 and 5, the maximum luminous intensity is seen to occur at an angle of about 70° from the vertical. The resultant illumination across a ceiling is thus acceptable for distances of 10 to 20 feet. The ceiling and upper walls reflect the light throughout the room. For rooms where there is one luminaire for each 20 foot square space, the luminance ratios across the ceiling and throughout the room are within 10 to 1 at all viewing angles. The resultant space is therefore considered substantially glareless.

What we claim is:

1. A luminaire for high intensity lighting devices which comprises an upwardly opening reflective bowl, terminating in a substantially circular outer lip, the diameter of said reflective bowl being greater on the outer lip than on the lower end; a base integrally disposed upon the lower end of said bowl; means to hold a high intensity light source substantially axially within said bowl and arranged relative to said lip so that the radiation which is emitted substantially below the horizontal plane of said outer lip will be reflected over said outer lip; said bowl being formed of a plurality of reflective flutes and having an optical shape so that substantially all the light which emerges from the light source leaves the luminaire after no more than one reflection, thereby substantially eliminating trapping of the light within the luminaire or reflection through said source.

2. The luminaire according to claim 1 wherein a reflective refractor is disposed upon the base.

3. The luminaire according to claim 1 wherein the bowl is supported by a plurality of radial arms extending from a socket cover which holds the socket and light source.

4. A luminaire for a high intensity lighting device said luminaire comprising: an upwardly opening reflective bowl, terminating in a substantially circular outer lip, the diameter of said reflective bowl being greater on the outer lip than at the lower end; a base integrally disposed on the lower end of said bowl; means for holding a high intensity lighting device substantially axially within said bowl and arranged so that the radiation which is emitted substantially below the horizontal plane of said outer lip will be reflected over said outer lip and means to hold said bowl in a fixed spatial relationship relative to said lighting device, the optical shape of said bowl being an ellipitical surface of revolution, one focus of which is disposed at said light source and the second focus being disposed at a point over said outer lip of said bowl.

5. The luminaire according to claim 4 wherein a multiplicity of flutes are positioned vertically around the interior of said bowl.

6. The luminaire according to claim 5 wherein the flutes are formed on a stamped sleeve arranged as an insert within said bowl.

7. The luminaire according to claim 5 wherein the flutes form the bowl.

8. The luminaire according to claim 4 wherein a refractor is arranged upon the base.

9. A luminaire according to claim 4 wherein substantially all radiation from said lighting device leaves the luminaire after no more than one reflection, thereby substantially eliminating trapping of the radiation with the luminaire or reflection through said lighting device.

* * * * *